United States Patent [19]

Jud

[11] Patent Number: 4,811,848

[45] Date of Patent: Mar. 14, 1989

[54] PACKAGE WITH A GAS-TIGHT PACKAGE ENVELOPE

[75] Inventor: Wilfried Jud, St. Poelten, Austria

[73] Assignee: Folienwalzwerk Brueder Teich Aktiengesellschaft, Obergrafendor-Muhlhofen, Austria

[21] Appl. No.: 57,163

[22] Filed: Jun. 1, 1987

Related U.S. Application Data

[63] Continuation of Ser. No. 801,141, Nov. 22, 1985, abandoned, which is a continuation of Ser. No. 491,317, Apr. 18, 1983, abandoned.

[51] Int. Cl.[4] ..... B65D 17/32

[52] U.S. Cl. ..... 206/610; 206/604; 206/611; 206/628; 206/632

[58] Field of Search ..... 206/604, 611, 628, 630, 206/632, 633, 610; 229/7 R, 17 R, 3.5 MF

[56] References Cited

U.S. PATENT DOCUMENTS

| | | | |
|---|---|---|---|
| 2,218,670 | 10/1940 | Bennett | 229/7 R |
| 3,442,436 | 5/1969 | Kirby, Jr. | 206/628 |
| 3,580,466 | 5/1971 | Thelen et al. | 206/628 |
| 3,687,352 | 8/1972 | Kalajian | 229/7 R |
| 3,687,358 | 8/1972 | Wink et al. | 206/630 |
| 3,710,011 | 1/1973 | Kugler | 229/7 R |
| 3,795,359 | 3/1974 | Rausing | 229/3.5 MF |
| 4,165,004 | 8/1979 | Bartels | 229/7 R |
| 4,194,680 | 3/1980 | Scott et al. | 206/628 |
| 4,258,876 | 3/1981 | Ljungcrantz | 229/7 R |
| 4,260,061 | 4/1981 | Jacobs | 206/632 |

FOREIGN PATENT DOCUMENTS

| | | | |
|---|---|---|---|
| 1054008 | 3/1959 | Fed. Rep. of Germany | 229/7 R |
| 402729 | 5/1966 | Switzerland | 229/7 R |

*Primary Examiner*—Stephen P. Garbe

*Attorney, Agent, or Firm*—Bierman & Muserlian

[57] ABSTRACT

Gas-tight packages for enclosing solid articles such as chocolates and other non-perishable baked goods in the form of a tubular pouch package which is easily opened and can be stream lined wherein the pouch has a gas-tight envelope made of a flexible sheet-like packaging material provided with zones where the packaging material is doubled and with a tear-open means.

8 Claims, 2 Drawing Sheets

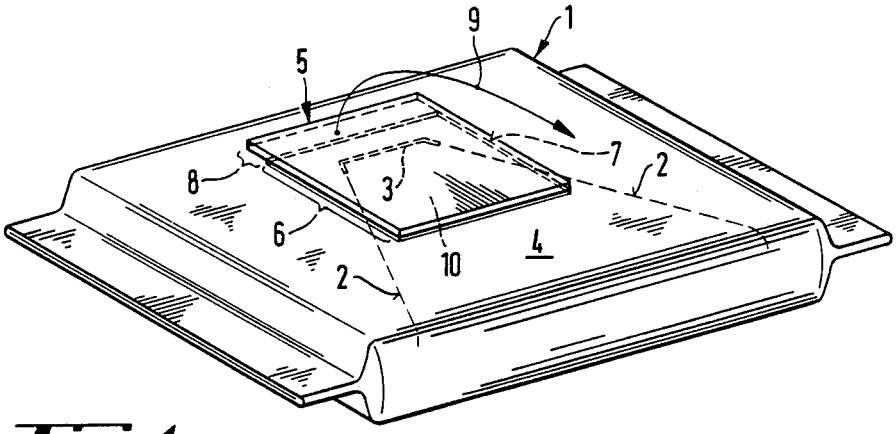
Fig. 1
Fig. 2
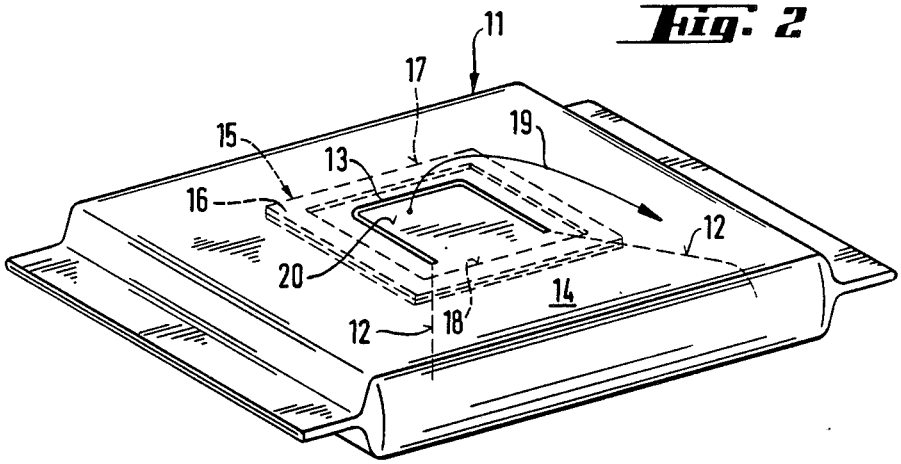

PACKAGE WITH A GAS-TIGHT PACKAGE ENVELOPE

PRIOR APPLICATION

This application is a continuation of U.S. patent application Ser. No. 801,141 filed Nov. 22, 1985 which is a continuation of U.S. patent application Ser. No. 491,317 filed Apr. 18, 1983, both now abondoned.

FIELD OF THE INVENTION

The invention relates to a package with a gastight package envelope, consisting of a sheet-like, in particular flexible packaging material and a tear-open device which is intended, when the package is opened, to be gripped by its front end and to be pulled in a given tear-open direction, the packaging material tearing at the edges of a strip-shaped or tab-shaped tear-open zone.

PRIOR ART

A package of this type is known from the published PCT Application No. WO 80/02827 (Application No. PCT/AT 80/00017) of the Applicant. In this known package which is advantageously manufactured from a two-ply packaging material and/or is made as a tubular pouch package, the lateral edges of the tear-open zone are formed by lines of weakness provided in the packaging material, along with lines the material tears when the package is opened. The front end of the strip-shaped tear-open aid is here located in a zone of the packaging material where it is doubled, that is to say, in the case of a tubular pouch package, for example, in one of its fin-shaped sealing areas. Lines of weakness provided in a special way on the packaging material in the said doubling zone make it possible to operate the tear-open device without problems, while maintaining the gas-tightness of the packaging envelope. In the package, described in the abovementioned PCT application, with a gas-tight package envelope, the front end of the tear-open device is located in a zone where the packaging material is doubled, that is to say, for example, on the fins of a tubular pouch package, which are formed by sealing seams. This is of course a restriction with regard to the arrangement or design of the tear-open device.

SUMMARY OF THE INVENTION

The object on which the invention is based is achieved in the package according to the invention, which is characterised in that the packaging material has a perforation in the form of a line or a section of lines of weakness at the front end of the tear-open zone and that, in the zone of this perforation in the form of a line or this section of lines of weakness, the packaging material is overall-bonded in a releasable manner, preferably by means of a binder layer, to a covering element which preferably consists of a sheet-like material and of which the surface zone, which is overall-bonded to the packaging material, has an outer contour which completely surrounds but does not touch the perforation in the form of a line.

When the package is opened, the front end of the covering element forming the tear-open device is gripped and pulled off in the tear-open direction. The packaging material thus tears—starting at both ends of the perforation in the form of a line or the section of lines of weakness—at the lateral edges of the tear-open zone.

According to an advantageous embodiment of the package according to the invention, additional lines of weakness are provided in the packaging material, which lines of weakness, starting from the ends of the perforation in the form of a line or the section of lines of weakness, form the edges on both sides of the tear-open zone, along which edges the packaging material tears when the package is opened.

According to an advantageous embodiment of the package according to the invention, the covering element is situated on the outer envelope of the package envelope, and the minimum distance of the outer contour of the surface zone, overall-bonded to the packaging material, of the covering element from the perforation in the form of a line or section of lines of weakness in the packaging material is at least 1 mm, and preferably at least 5 mm. Advantageously, the covering element consisting of a sheet-like material can here have a part zone which is not bonded directly to the packaging material and forms a tab which can be lifted off.

According to another advantageous embodiment of the package according to the invention, the covering element consisting of a sheet-like material is situated on the inside of the package envelope and the surface zone, overall-bonded to the packaging material. The covering element has, in addition to its outer contour, an inner contour which forms a closed loop the minimum distance of which from the outer contour is at least 1 mm, and preferably at least 5 mm. At at the front end of the tear-open zone, the said inner contour crosses the perforation in the form of a line only at two points or not at all, so that a packaging material tab which is delimited by said perforation in the form of a line and which can be lifted off is formed at the front end of the tear-open zone.

In a further advantageous embodiment of the package according to the invention, having a package envelope zone which at least approximately has the shape of a prism or cylinder, the covering element consisting of a sheet-like material is arranged within this zone of the package envelope and this zone is covered by an envelope-shaped loop of sheet-like material. Advantageously, in the zone of the perforation in the form of line and or of the section of lines of weakness, the envelope-shaped loop can here at the same time form the covering element.

According to advantageous embodiments of the invention, the package according to the invention can be formed from a plastic monofilm, from paper or from an aluminum foil.

According to another advantageous embodiment of the invention, the packaging material is made as a composite material from at least two different plies of web-shaped sheet-like material, of which plies one serves mainly as the support layer and the other mainly as the gas-tight layer. In the case where no additional lines of weakness are provided for laterally delimiting the tear-open zone, the support layer in the package advantageously faces the packed material. The support layer can here advantageously be made of a paper web or a plastic film, whilst the gas-tight layer can advantageously consist of an aluminum foil or a plastic film.

BRIEF DESCRIPTION OF THE DRAWINGS

FIG. 1 is a perspective view of an embodiment of a tubular powder package of the invention and FIG. 2 is a perspective view of a second embodiment of the invention.

Figures 3, 4:
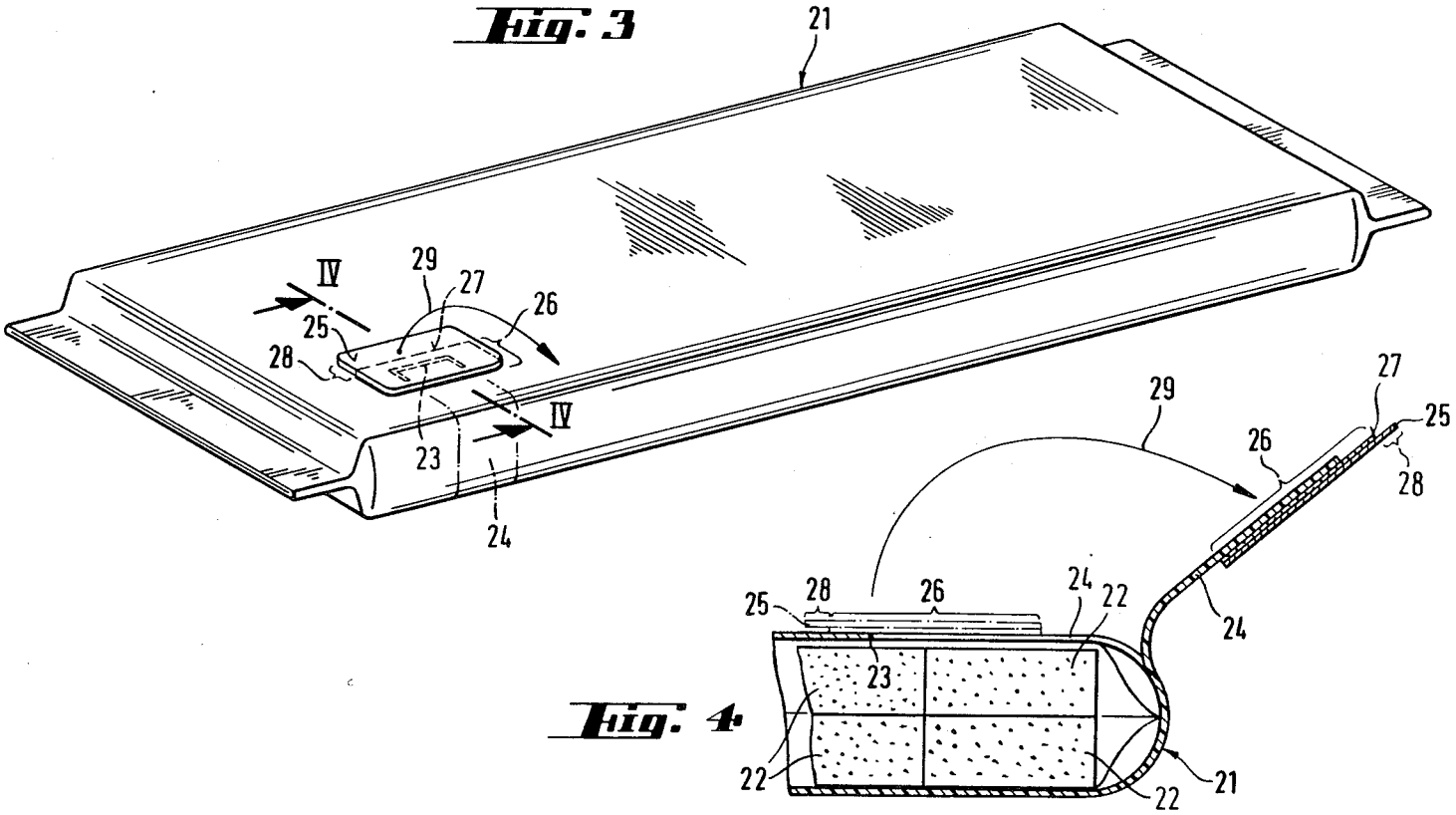
FIG. 3 is a perspective view of an embodiment of a pouch of the invention with no lines of weakness and FIG. 4 is a partial cross-section of the said embodiment taken along line IV—IV of FIG. 3.

The starting material for the packages described with reference to FIGS. 1 and 2 is, for example, a multi-ply packaging material which comprises a support layer which comes to lie on the outside of the package and consists of a coated kraft paper having a substance weight of 50–70 g/m$^2$, a 0.009 mm thick aluminum foil laminated thereto as the gas-tight layer and, adjoining the latter, a layer of sealing medium. Depending on the type of sealing to be carried out, the layer of sealing medium advantageously consists of a heat-sealing medium, such as a PE coating of PVDC coating or a hot-melt coating of a thickness of 0.02 to 0.06 mm, or of a coating of a cold-setting adhesive based on latex with an application rate of 2–7 g/m$^2$ (solids).

FIG. 1 shows, in a perspective view, a tubular pouch package 1, the packing material of which has two lines of weakness 2, the ends of which are connected to one another by a perforation 3 along and in the form of a line, provided in the packaging material, in such a way that these lines of weakness 2 and the perforation 3 in the form of a line delimit a tear-open zone 4.

In the zone of this perforation, the packaging material is glued to a sheet-like covering element 5 (which, for the sake of clarity, is shown in FIG. 1 in an exaggeratedly large thickness) in a releasable manner over a zone 6 of the surface of the covering element, the outer contour 7 of this surface zone 6 completely surrounding but not touching the perforation 3 in the form of line and. The perforation 3 in the form of a line, which represents an opening in the packaging material, is closed gas-tight by the covering element 5. In order to achieve adequate gas-tightness, the mininum distance of the contour 7 from the perforation 3 in the form of a line is here about 5 mm. Additionally, the covering element 5 which, for example, can advantageously be an adhesive label, is not glued to the packaging material in an edge zone 8 which is located opposite the lines of weakness which run outwards.

When the package is torn open, the edge zone 8 of the covering element 5 is gripped and first pulled off from the packaging material in the direction of the arrow 9 and then taken along the tear-open zone 4. While this is done, the covering element 5 is not detached from the front end 10 of the tear-open zone, so that the package is opened in a customary manner by tearing of the lines of weakness 2. The U-shaped perforation 3 has the effect that, during the tearing-open process, there is no significant resistance to the tear-open zone 4 being pulled off, and the packaging material can be torn at its lines of weakness 2 rapidly and with a small effort.

In some cases, however, it is then possible, instead of the perforation in the form of a line, which connects the two lines of weakness 2, to provide a section of a line of weakness which is realised in particular by superficial punching. The important point here is that the adhesion of the overall bond, by means of which the covering element is joined to the front end of the tear-open strip, is sufficient for transmitting the force which is required for tearing open the packaging material at the sections of lines of weakness, which connect the two lines of weakness 2. Since no perforation is provided in these package variants, the covering element loses its sealing function, and it is sufficient for the covering element to be overall-bonded to the packaging material only at the front end of the tear-open zone.

FIG. 2 shows a tubular pouch package 11 which, analogously to the package according to FIG. 1, has a tear-open zone 14 which is delimited by lines of weakness 12 and a perforation 13 in the form of a line which joins these lines of weakness. In this package variant, a sheet-like covering element 15 is then glued to the inside of the packaging material in the zone of the perforation 13 in the the form of a line. The surface zone 16, which is overall-bonded to the packaging material in this gluing, of the covering element 15 is shaped in the form of a window, that is to say it has, in addition to an outer contour 17, an inner contour 18 which delimits the window opening and within which the covering element 15 is not glued to the packaging material. The minimum distance of this inner contour 18 from the outer contour 17 is here about 5 mm. The opening formed in the packaging material by the perforation 13 in the form of a line is then closed gastight by the covering element 15, in a manner similar to that of the package according to FIG. 1. Since, in the present package according to FIG. 2, the covering element 15 is not glued to the packaging material in the zone of the perforation 13 in the form of a line, the front end 20 of the tear-open zone forms a packaging material tab which can easily be lifted off.

When the package is torn open, the front end 20 of the tear-open zone 14 is gripped and pulled off in the direction of the arrow 19, with tearing of the lines of weakness 12 and detachment from the covering element 15 fitted on the inside of the packaging material.

In the two package variants described by reference to FIGS. 1 and 2, the tear-open zones in each case take up a relatively large part of the front surface of the package.

In order to cover these tear-open aids for aesthetic reasons, or in order to protect them from possible mechanical damage, a tubular shaped additional envelope made of a sheet-like material such as paper is put onto the prismatic envelope zone of such package. The outer make-up of the package, i.e. such as colors, pictures and other markings is then provided on this additional envelope and will therefore not be impaired by the design of the tearopen aid. In a package such as that according to FIG. 1, however, the said tubular shaped additional envelope can advantageously be designed in such a way that at the same time it forms the covering element.

It has been found that the the tear-open device of the package according to the invention in many cases functions in a well reproducible manner, even if the tear-open zone is not laterally delimited by lines of weakness. In these cases, the packaging material tears, starting at both ends of the perforation, along two lines which are essentially parallel or slightly converge or slightly diverge. This is the case, for example, if the packaging material consists of certain single-ply materials, such as paper, a biaxially stretched polypropylene (OPP) or an aluminum foil. When those multi-ply packaging materials are employed as are preferably used for the construction of gas-tight packages, such as tubular pouch packages, however, differentiated tearing behaviour is found.

In the case of packaging material which comprise a support layer and a gas-tight layer joined thereto and consisting of a homogeneous, gas-tight material which is nevertheless readily tearable, which layers are formed during manufacture by web-shaped plies, well reproducibletearing of the packaging material, which does not excessively diverge or converge in the shape of a wedge, is as a rule found—in particular if the packages are torn open rapidly—only if the support material faces the packaged goods.

Such a packaging material which is of three-poly construction consists, for example—starting from the outside of the package—of a 0.012 to 0.020 mm thick film of biaxially stretched polypropylene (OPP), an 0.009 mm thick aluminum foil, a kraft paper of a substance weight of 40–60 g/m$^2$ and a coating of cold-setting adhesive based on latex (2–7 g/m$^2$ of solids).

FIG. 3 shows a perspective view of a package according to the invention which is manufactured, for example, from such a packaging material and is designed as a tubular pouch package, wherein no lines of weakness are provided.

The packaging material here has a U-shaped perforation 23 which is closed again by an adhesive label, which is partially coated with an adhesive, as the covering element 25. The outer contour 27 of the adhesive zone 26 of the covering element 25 here completely surrounds but does not touch the U-shaped perforation 33. The covering element 25 also has an edge zone 28 which is not bonded to the packaging material.

When the package is torn open, the covering element 25 is gripped and pulled off in the direction of the arrow 29. The packaging material thus tears along two lines which run approximately parallel to one another and which delimit the tear-open zone 24 on both sides. Figure 4 shows a sectional part representation of the package during the tear-open process. If, however, in a package according to FIGS. 3 and 4, a packaging material is used which—from the outside inwards—comprises an OPP film, a kraft paper, and aluminum foil and finally the coating with a cold-setting adhesive (for example, each in the individual thicknesses as indicated in connection with FIG. 3), the tearing lines—in particular when the package is torn open rapidly—converge in the shape of a wedge so that an opening useful for taking out packaged goods is not formed.

A two-ply packaging material which is suitable for packages according to the invention, which manage without lines of weakness delimiting the tear-open zone laterally, consists furthermore of, for example—from the outside inwards—an aluminum foil, a coated kraft paper and the coating of cold-setting adhesive, each of these in individual thicknesses such as are indicated, for example, for the packaging material used in connection with FIGS. 1 and 2.

Other suitable two-ply packaging material consist, for example—from the outside inwards in each case—of a 0.012 to 0.030 mm thick OPP film, a 0.02 to 0.04 mm thick PE film and a coating of cold-setting adhesive or of a 0.009 mm thick aluminum foil, a 0.02–0.03 mm thick OPP film and the coating of cold-setting adhesive. In the first case, the PE film forms the support film and, in the second case, the OPP film forms the (thicker) support layer.

COMMERCIAL APPLICABILITY

The gas-tight package according to the invention can above all be employed advantageously as a package for foodstuffs, such as chocolates or non-perishable baked goods and is made, if appropriate, in the form of a tubular pouch package. However, its commercial applicability is not restricted to packages for solid packaged goods.

I claim:

1. A package comprising a solid object enclosed in a gas-tight envelope of a flexible sheet-like packaging material provided with zones where the packaging material is doubled and with a tear-open means, the purpose of which is to tear off a strip shaped portion of the envelope beginning with a front edge of this strip-shaped portion for getting access to the enclosed object, characterized in that the tear-open means comprises at least one of a perforation in the form of a line and line of weakness in the packaging material of the envelope along a part of the boundary of the strip-shaped portion of the envelope to be torn off, the front end of the strip-shaped portion being situated outside the zones where the packaging material is doubled and a sheet-like covering element at said at least one of a perforation in the form of a line and line of weakness which covering element has a surface portion having an outer contour within which the entire surface portion of the covering element is bonded to the packaging material by an adhesive, said outer contour enclosing a part of the said at least one of perforation in the form of a line and a line of weakness whereby no perforation in the form of a line is situated outside of the said outer contour, whereby the covering element may be torn off while tearing the envelope along the boundary of the strip-shaped portion of the envelope.

2. A package of claim 3 wherein the outer contour of the said surface portion surrounds the perforation in the form of line and has a minimum distance from the said perforation line of at least 1 mm.

3. A package of claim 1 wherein the outer contour of the surface portion of the covering element which is bonded to packaging material surrounds the perforation in the form of a line line but does not touch the latter.

4. A package of claim 1 wherein the covering element has a portion which adjoins S but is not bonded directly to the packaging material to form a tab for lift off.

5. A package comprising a solid object enclosed in a gas-tight envelope of a flexible sheet-like packaging material provided with zones where the packaging material is doubled and with a tear-open means, the purpose of which is to tear off a strip-shaped portion of the envelope beginning with a front edge of this strip-shaped portion for getting access to the enclosed object, characterized in that the tear-open means comprises at least one of a perforation in the form of a line and a line of weakness in the packaging material of the envelope along at least part of the boundary of the strip-shaped portion of the envelope to be torn off, the front edge of the strip-shaped portion being situated outside the zones where the packaging material is doubled and a sheet-like covering element at said at least one of a perforation in the form of a line and line of weakness which covering element has a surface portion having an outer contour within which the entire surface portion of the covering element is bonded to the packaging material, said outer contour enclosing the at least one of a perforation in the form of a line and line of weakness, whereby the covering element may be torn off while tearing the envelope along the boundary of the strip-shaped portion of the envelope, the packaging material being a composite material made of at least two different plies of web shaped sheet-like material, one ply serving as a support layer facing the object enclosed and one ply serving as a gas-tight layer.

6. A package of claim 5 wherein the support layer is made of paper or a plastic film.

7. A package of claim 5 wherein the gas-tight layer is made of aluminum.

8. A package of claim 5 wherein the gas-tight layer is made of plastic film.

* * * * *